US011648650B1

(12) United States Patent
Kuo

(10) Patent No.: US 11,648,650 B1
(45) Date of Patent: May 16, 2023

(54) TORQUE STRUCTURE

(71) Applicant: Wen-Chin Kuo, Taichung (TW)

(72) Inventor: Wen-Chin Kuo, Taichung (TW)

( * ) Notice: Subject to any disclaimer, the term of this patent is extended or adjusted under 35 U.S.C. 154(b) by 21 days.

(21) Appl. No.: 17/506,788

(22) Filed: Oct. 21, 2021

(51) Int. Cl.
*B25B 23/14* (2006.01)
*B25B 23/142* (2006.01)

(52) U.S. Cl.
CPC ..... *B25B 23/141* (2013.01); *B25B 23/1427* (2013.01)

(58) Field of Classification Search
CPC .. B25B 23/142; B25B 23/1427; B25B 23/141
USPC ..... 81/473, 474, 475, 478, 480
See application file for complete search history.

(56) References Cited

U.S. PATENT DOCUMENTS 6,463,834 B2 * 10/2002 Kemp ..... B25B 23/1427 81/481
8,371,194 B2 * 2/2013 Wu ..... B25B 23/1427 81/478
2017/0095911 A1 * 4/2017 Hsieh ..... G01L 25/003

* cited by examiner

*Primary Examiner* — Joseph J Hail
*Assistant Examiner* — Robert C Moore
(74) *Attorney, Agent, or Firm* — Alan D. Kamrath; Karin L. Williams; Mayer & Williams PC

(57) ABSTRACT

A torque structure includes a first body, a second body, an elastic member, and a locking set. The first body has a receiving chamber. The second body is provided with a drive portion, a plurality of first securing portions, and a first end face. The locking set includes a locking member, a plurality of securing members, a plurality of balls, and a washer. The locking member is provided with a pivot portion, a plurality of second securing portions, and a second end face. The securing members are mounted in the first securing portions and the second securing portions. The washer is mounted on the locking member elastically biased between the first end face and the second end face to space the second body from the locking member. The washer eliminates a gap between the locking member and the second body.

8 Claims, 10 Drawing Sheets

A-A

TORQUE STRUCTURE

BACKGROUND OF THE INVENTION

1. Field of the Invention

The present invention relates to a hand tool and, more particularly, to a torque structure.

2. Description of the Related Art

A conventional torque structure 10 was disclosed in the U.S. Pat. No. 6,463,834, and comprises a fastener drive structure, generally shown at 20, a wrench body, generally shown at 30, a tang engaging and stabilizing structure, generally shown at 40, a stressed biasing element, generally shown at 50, and an adjuster, generally shown at 60. The fastener drive structure 20 has a head 22 constructed and arranged to be removably engaged with a fastener and a tang structure 24 extending rearwardly from the head 22. The tang structure 24 has a hole 26 extending through a front portion 25 thereof. The head 22 comprises a mounting portion 28 integrally formed with the tang structure 24 and a conventional ratchet drive assembly (not shown), which is received within the mounting portion 28. The wrench body 30 includes a generally cylindrical casing structure 32 with generally cylindrical interior and exterior surfaces 34, 36. One end portion 35 of the casing structure 32 has a hole 38 therethrough. The opposite end portion 37 is constructed to mount the adjuster 60. The tang engaging and stabilizing structure 40, also referred to as a plunger, has a tang engaging portion 42 and a pair of stabilizing ear members 44, 46 spaced apart from one another in the direction of the pivot axis 80. A shaft 48 extends rearwardly from the tang engaging portion 42. The stabilizing ear members 44, 46 are positioned on opposing sides of a rear end portion 27 of the tang structure 24 to restrict movement of the tang structure rear end portion 27 generally in the direction of the pivot axis 80, but allow relative pivotal movement between the casing structure 32 and the fastener drive structure 20 about the pivot axis 80. The stabilizing ear members 44, 46 have rounded outer surfaces 45 conforming to the interior surface 34 of the casing structure 32. Inner surfaces 47 of the ear members 44, 46 are parallel to each other and perpendicular to the pivot axis 80. The load screw 70 is a component of the adjuster 60 and axial movement thereof adjusts the stress in the biasing element 50 and hence the biasing force applied to the tang engaging portion 42 by the biasing element 50. Specifically, the load screw 70 has a threaded shaft portion 71. A load nut 74 is secured to the end portion 37 of the casing structure 32 by retaining pins 75, which pins 75 extend through holes in the casing structure 32 and the load nut 74. The shaft portion 71 extends through the load nut 74 and is fixed within a grip portion, generally shown at 62, of the adjuster 60. The grip portion 62 comprises a front portion 64 and a rear portion 66, which are coupled such that axial movement with respect to one another is permitted. The front portion 64 is biased forwardly from the rear portion 64 by a spring 65. The front portion 64 has a plurality of recesses 68, wherein each recess 68 includes a locking portion and an adjusting portion. The recesses 68 of the front portion 64 are positioned over a corresponding series of longitudinally extending grooves 33 of the casing structure 32. A ball 76 is received between the locking portion of each recess 68 and a corresponding groove 33 to prevent rotational movement of the grip portion 62 with respect to the casing structure 32. Referring to FIG. 8, to adjust the biasing force, the front portion 64 is moved rearwardly relative to the rear portion 66 against the biasing of the spring 65 such that the balls 76 are positioned in the adjusting portions of the recesses 68. Rotational movement of the gripping portion 62 rotates the gripping portion 62 relative to the casing structure 32, with the balls 76 moving along adjacent grooves 33. This rotational movement of the gripping portion 62 adjusts the load screw 70 axially with respect to the load nut 74 to adjust the biasing force applied to the tang engaging and stabilizing structure 40 by the biasing element 50.

However, the conventional torque structure 10 has the following disadvantages.

1. The retaining pins 75 are mounted on the interior surfaces 34 and the load nut 74 by an external force so that the retaining pins 75, the interior surfaces 34, and the load nut 74 are fit closely. Thus, the wrench body 30 and the load nut 74 have little tolerance defined therebetween so that the load screw 70 is rotated exactly. However, it is necessary to mount the retaining pins 75 on the interior surfaces 34 and the load nut 74 by an external arrangement, such as a hydraulic device or the like, thereby increasing the cost of fabrication. When the retaining pins 75 are replaced by balls, each of the balls has a diameter less than that of the hole of each of the interior surfaces 34 and that of the hole of the load nut 74, so that the balls, the interior surfaces 34, and the load nut 74 are fit loosely. However, the wrench body 30 and the load nut 74 have a determined tolerance defined therebetween so that the load screw 70 is not rotated exactly.

2. The load screw 70 and the load nut 74 are assembled previously and are then mounted in the wrench body 30. Then, the retaining pins 75 are mounted on the interior surfaces 34 and the load nut 74. Thus, the operator's two hands have to press the retaining pins 75 simultaneously and to assemble the wrench body 30 and the load nut 74 with the adjuster 60, thereby causing inconvenience to the operator.

BRIEF SUMMARY OF THE INVENTION

In accordance with the present invention, there is provided a torque structure comprising a first body, a second body, an elastic member, and a locking set. The first body has an interior provided with a receiving chamber. The second body is provided with a drive portion, a plurality of first securing portions, and a first end face. The locking set includes a locking member, a plurality of securing members, a plurality of balls, and a washer. The locking member is provided with a pivot portion, a plurality of second securing portions, and a second end face. The securing members are mounted in the first securing portions and the second securing portions so that the locking member is secured to the second body. The washer is mounted on the locking member and made of resilient material. The washer is elastically biased between the first end face and the second end face to space the second body from the locking member. The washer eliminates a gap between the locking member and the second body.

According to the primary advantage of the present invention, the first securing portions, the second securing portions, and the securing members are fit loosely so that the securing members are assembled conveniently. Each of the securing members rests on the first face and the second face. The washer is elastically biased between the second body and the locking member so that the second body and the locking member are spaced from each other by the elastic force of the washer. Thus, each of the securing members is locked between the first face and the second face by the elastic force of the washer to eliminate the gap between the locking member and the second body so that the locking member and the second body are fit closely. Thus, the torque structure has a double effect of easy assembly and gap elimination by provision of the washer.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
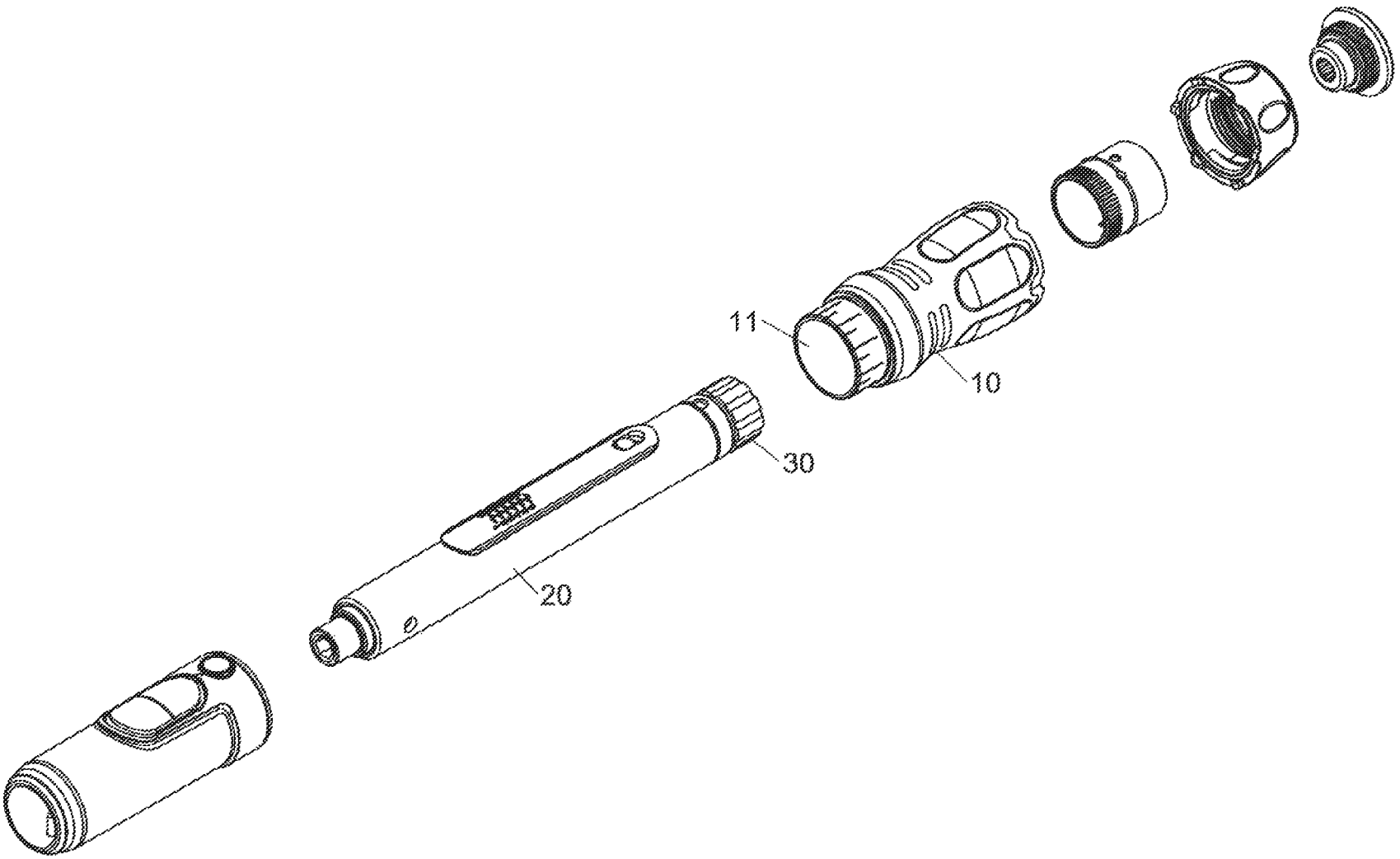
FIG. 1 is an exploded perspective view of a torque structure in accordance with the preferred embodiment of the present invention.

Referring to the drawings and initially to FIGS. 1-7, a torque structure in accordance with the preferred embodiment of the present invention comprises a first body 10, a second body 20, an elastic member 28, and a locking set 30.

The first body 10 is held by a user and rotated to adjust the torque of the torque structure. The first body 10 has an interior provided with a receiving chamber 11. The receiving chamber 11 has a circular shape and penetrates the first body 10.

The second body 20 is assembled with the first body 10 and has a tubular shape. Preferably, the second body 20 is pivotally connected with the first body 10 which is rotated relative to the second body 20 to adjust the torque of the torque structure. Alternatively, the second body 20 is secured with the first body 10. The second body 20 is partially received in the receiving chamber 11. An indication unit is movably mounted on the second body 20 to indicate the torque of the torque structure. The second body 20 has a first end provided with a drive portion 21 and a second end provided with a plurality of first securing portions 23 and a first end face 25. The drive portion 21 partially protrudes from the first body 10 and is preferably a hexagonal recess, a square head, a ratchet wrench, a box end wrench or an open end wrench. Each of the first securing portions 23 is a circular hole and is hidden in the receiving chamber 11. The first securing portions 23 are close to an opening of the second body 20 and distant from the drive portion 21. The first securing portions 23 are arranged in an annular shape about an axis of the second body 20. Preferably, the second body 20 has two first securing portions 23 which are arranged symmetrically. The second body 20 has a periphery provided with an annular groove 24. The annular groove 24 is connected to the first securing portions 23 and arranged at one side of the first securing portions 23. The first end face 25 has a planar shape and is provided on the opening of the second body 20.

The elastic member 28 is received in the second body 20 and elastically biased against the drive portion 21 (or a torque slip control member) of the second body 20 so that the second body 20 has a torque slip (or tipping) function formed between the second body 20 and the first body 10. Preferably, the elastic member 28 is a spring.

The locking set 30 is assembled with and cannot be moved or rotated relative to the second body 20. The locking set 30 is received in the receiving chamber 11 and includes a locking member 31, a plurality of securing members 32, a plurality of balls (or beads) 33, and a washer (or O-ring) 34.

The locking member 31 is assembled with the second body 20 and hidden in the receiving chamber 11. The locking member 31 cannot be moved or rotated relative to the second body 20 and is distant from the drive portion 21. The locking member 31 has an interior provided with a pivot portion 311 penetrating the locking member 31. Preferably, the pivot portion 311 is a circular recess. Alternatively, the pivot portion 311 has an interior provided with a threading. The locking member 31 is provided with a plurality of second securing portions 312 aligning with the first securing portions 23. Each of the second securing portions 312 is a circular hole. Preferably, each of the second securing portions 312 is a stepped circular hole. The second securing portions 312 have a number corresponding to that of the first securing portions 23. The locking member 31 has a first end provided with a plurality of positioning grooves 313. The positioning grooves 313 protrude from the second body 20 and are arranged in an annular shape about an axis of the locking member 31. Preferably, the locking member 31 has ten, twelve or twenty positioning grooves 313. Each of the positioning grooves 313 has an arcuate shape. The locking member 31 has a second end provided with a ball groove 314. The ball groove 314 is close to an opening of the pivot portion 311 and distant from the positioning grooves 313. The ball groove 314 has an annular shape and is hidden in the second body 20.

The locking member 31 is provided with a first peripheral face 316 hidden in the second body 20 and a second peripheral face 317 protruding from the second body 20. The second securing portions 312 are provided on the first peripheral face 316. The positioning grooves 313 are provided on the second peripheral face 317. The second peripheral face 317 has a diameter more than that of the first peripheral face 316. The second peripheral face 317 has a first end provided with a second end face 318 and a second end provided with a third end face 319. The second end face 318 faces the first end face 25 and is spaced from the first end face 25. The second end face 318 is arranged between the second securing portions 312 and the positioning grooves 313 and has a planar shape. The third end face 319 has a planar shape. The positioning grooves 313 are connected to the second end face 318 and the third end face 319. Each of the positioning grooves 313 has a length equal to that of the second peripheral face 317 and has a lengthwise direction the same as that of the second peripheral face 317. The diameter of the second peripheral face 317 is slightly less than that of the receiving chamber 11 and slightly more than or equal to that of the second body 20.

The securing members 32 are mounted in the first securing portions 23 and the second securing portions 312 so that the locking member 31 is secured to the second body 20. The securing members 32 have a number corresponding to that of the first securing portions 23 and that of the second securing portions 312. Each of the securing members 32 is a ball or a pin.

The first securing portions 23, the second securing portions 312, and the securing members 32 are fit loosely.

The balls 33 are arranged to form a ring and are rotatably mounted in the ball groove 314.

The washer 34 is mounted on the locking member 31 and made of resilient material. The washer 34 is elastically biased between the first end face 25 and the second end face 318 to space the second body 20 from the locking member 31. The washer 34 eliminates the gap between the locking member 31 and the second body 20. The washer 34 is an O-ring.

Figure 7:
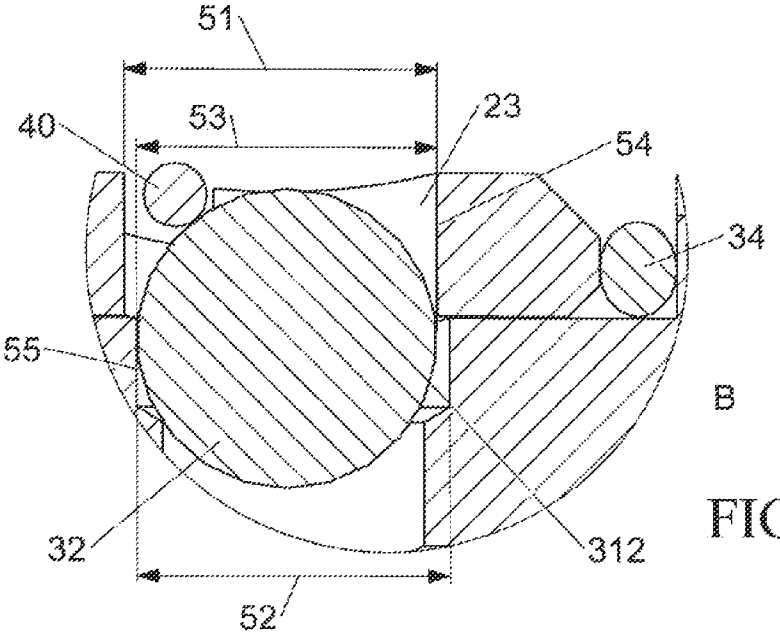
FIG. 7 is a locally enlarged view of the torque structure taken along circle B as shown in FIG. 6.

Especially referring to FIG. 7 with reference to FIGS. 1-6, each of the first securing portions 23 has a first diameter 51, each of the second securing portions 312 has a second diameter 52, and each of the securing members 32 has a third diameter 53. The first diameter 51 is about equal to the second diameter 52. The third diameter 53 is less than the first diameter 51 and the second diameter 52. That is, the first securing portions 23, the second securing portions 312, and the securing members 32 are fit loosely. Each of the first securing portions 23 has a first face 54, and each of the second securing portions 312 has a second face 55. Each of the securing members 32 rests on the first face 54 and the second face 55. The washer 34 is elastically biased between the second body 20 and the locking member 31 so that the second body 20 and the locking member 31 are pushed and moved away from each other by the elastic force of the washer 34. Thus, each of the securing members 32 is locked between the first face 54 and the second face 55 by the elastic force of the washer 34 to eliminate the gap between the locking member 31 and the second body 20 so that the locking member 31 and the second body 20 are fit closely.

The torque structure further comprises a snap ring 40 mounted in the annular groove 24 and pressing the securing members 32 so that each of the securing members 32 will not be detached from each of the first securing portions 23. The snap ring 40 is arranged between the first body 10, the second body 20, and the securing members 32. The snap ring 40 is made of a metal ring with elasticity.

Figure 2:
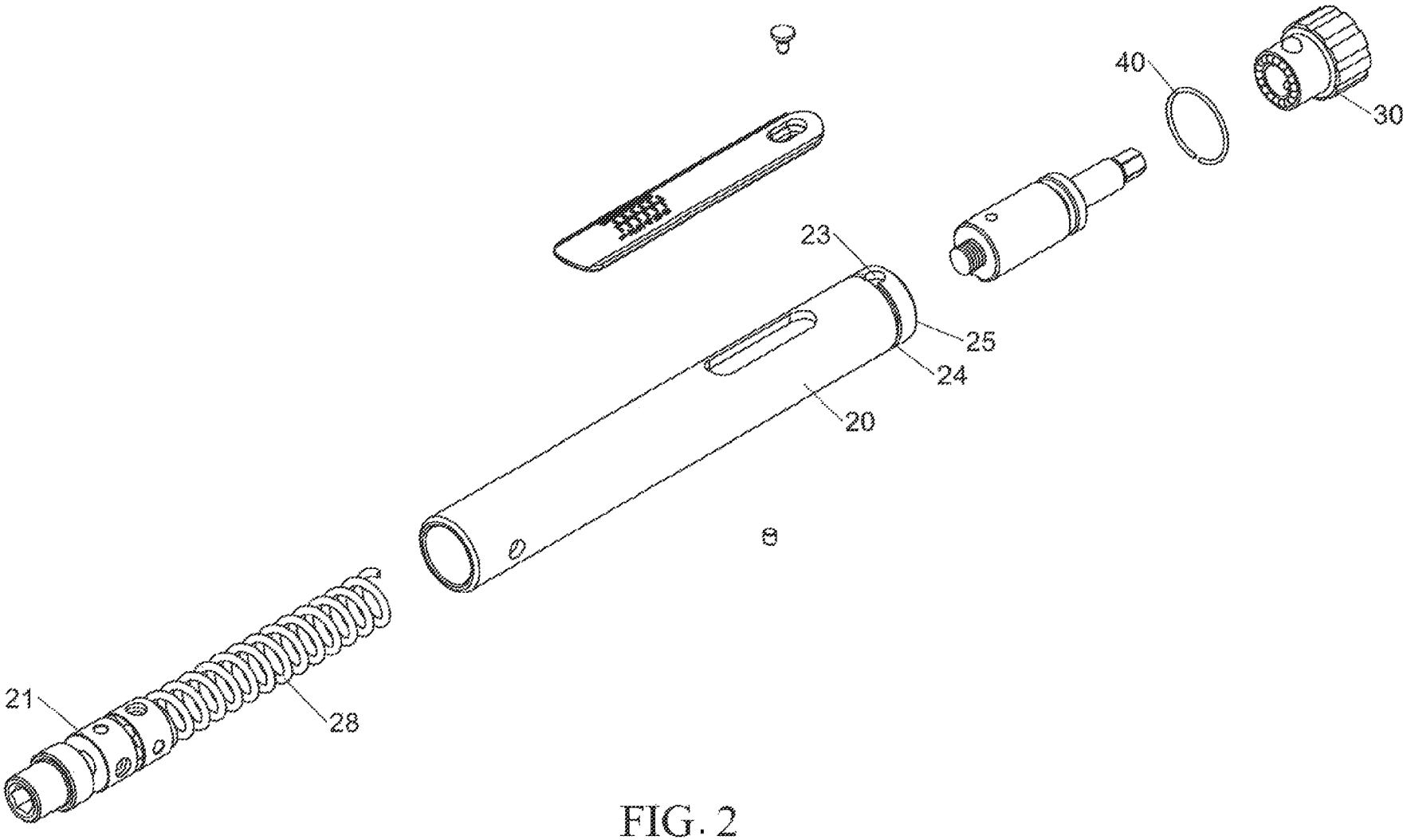
FIG. 2 is a partial exploded perspective view of the torque structure in accordance with the preferred embodiment of the present invention.
Figure 3:
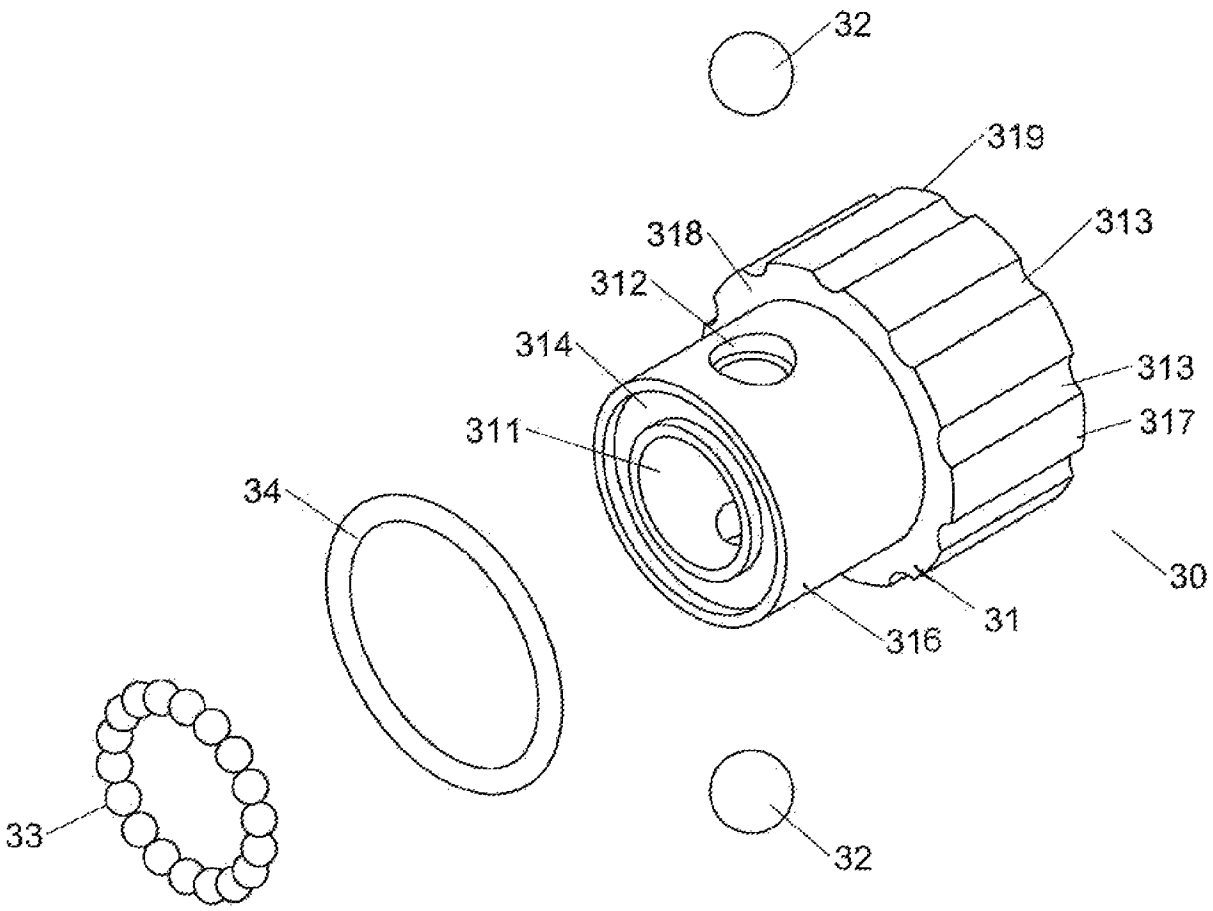
FIG. 3 is an exploded perspective view of a locking set of the torque structure in accordance with the preferred embodiment of the present invention.
Figure 4:
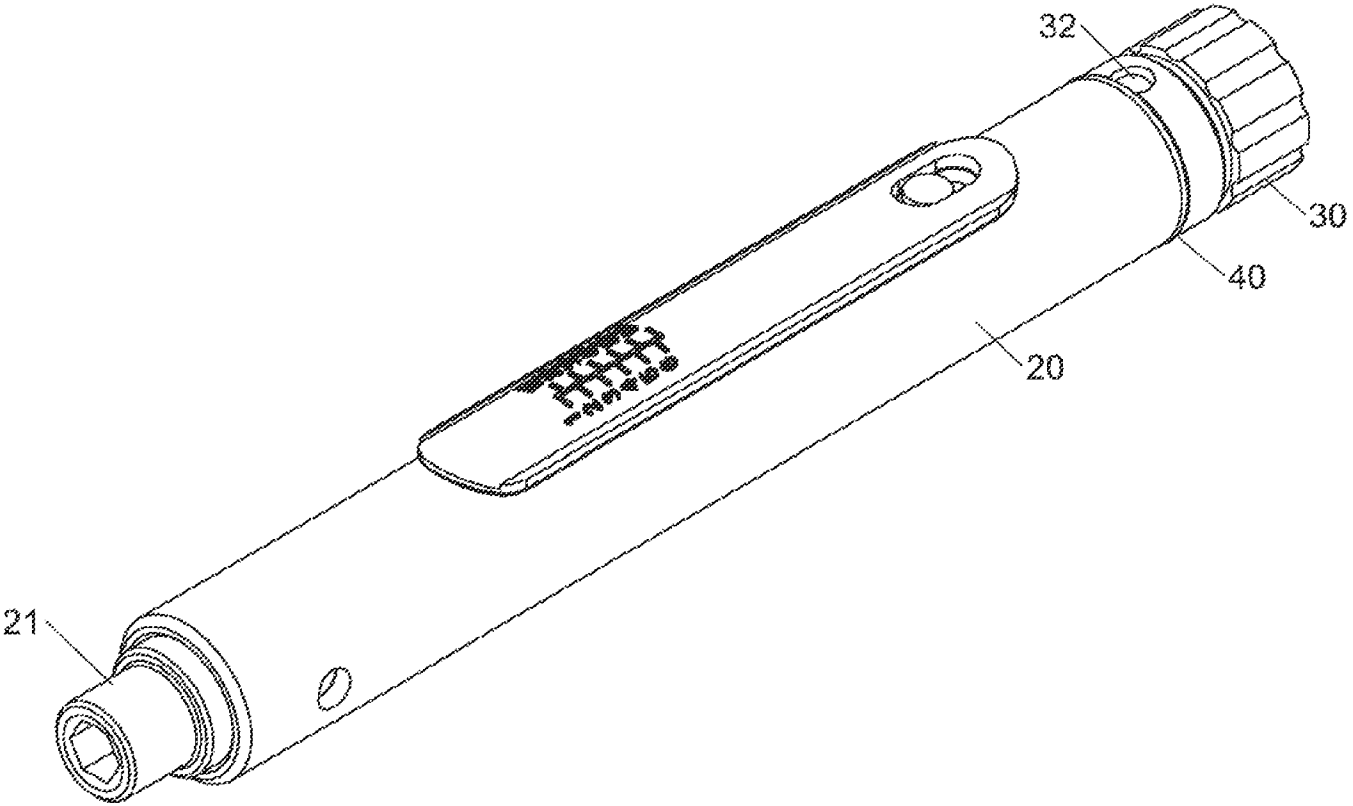
FIG. 4 is a partial perspective assembly view of the torque structure in accordance with the preferred embodiment of the present invention.

Referring to FIG. 4 with reference to FIGS. 1-3, the drive portion 21 is mounted on and partially protrude from the first end of the first body 10. The elastic member 28 is received in the second body 20. The locking set 30 is mounted on the second end of the first body 10. The second end face 318 faces the first end face 25. The securing members 32 are mounted in the first securing portions 23 and the second securing portions 312 so that the locking member 31 is secured to the second body 20 and cannot be moved or rotated relative to the second body 20. The snap ring 40 is snapped into the annular groove 24 and presses the securing members 32

Figure 5:
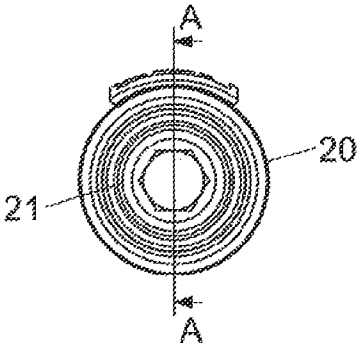
FIG. 5 is a partial side view of the torque structure in accordance with the preferred embodiment of the present invention.
Figure 6:
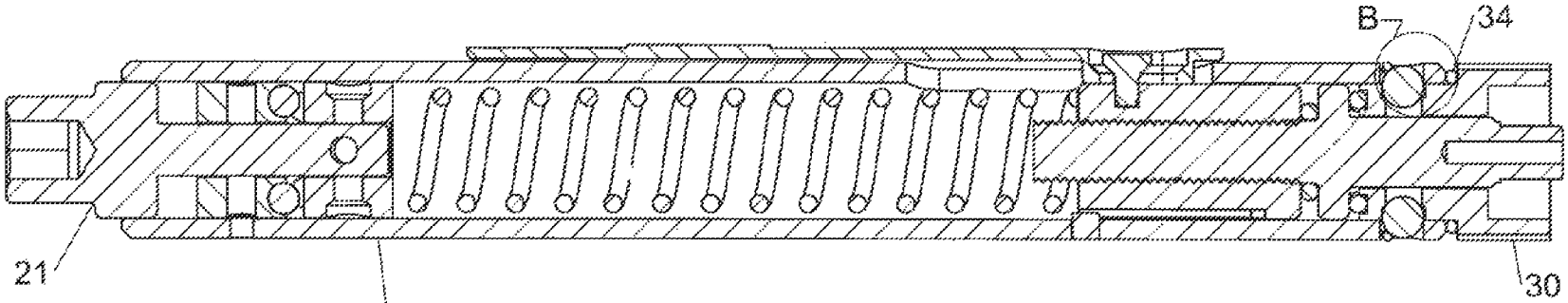
FIG. 6 is a cross-sectional view of the torque structure taken along line A-A as shown in FIG. 5.

Referring to FIGS. 5-7 with reference to FIGS. 1-4, each of the securing members 32 is locked between the first face 54 and the second face 55 by the elastic force of the washer 34 to eliminate the gap between the locking member 31 and the second body 20 so that the locking member 31 and the second body 20 are fit closely. Each of the securing members 32 are restricted by the snap ring 40, the first face 54, and the second face 55 so that the securing members 32 cannot be detached from the first securing portions 23 and the second securing portions 312

Figure 8:
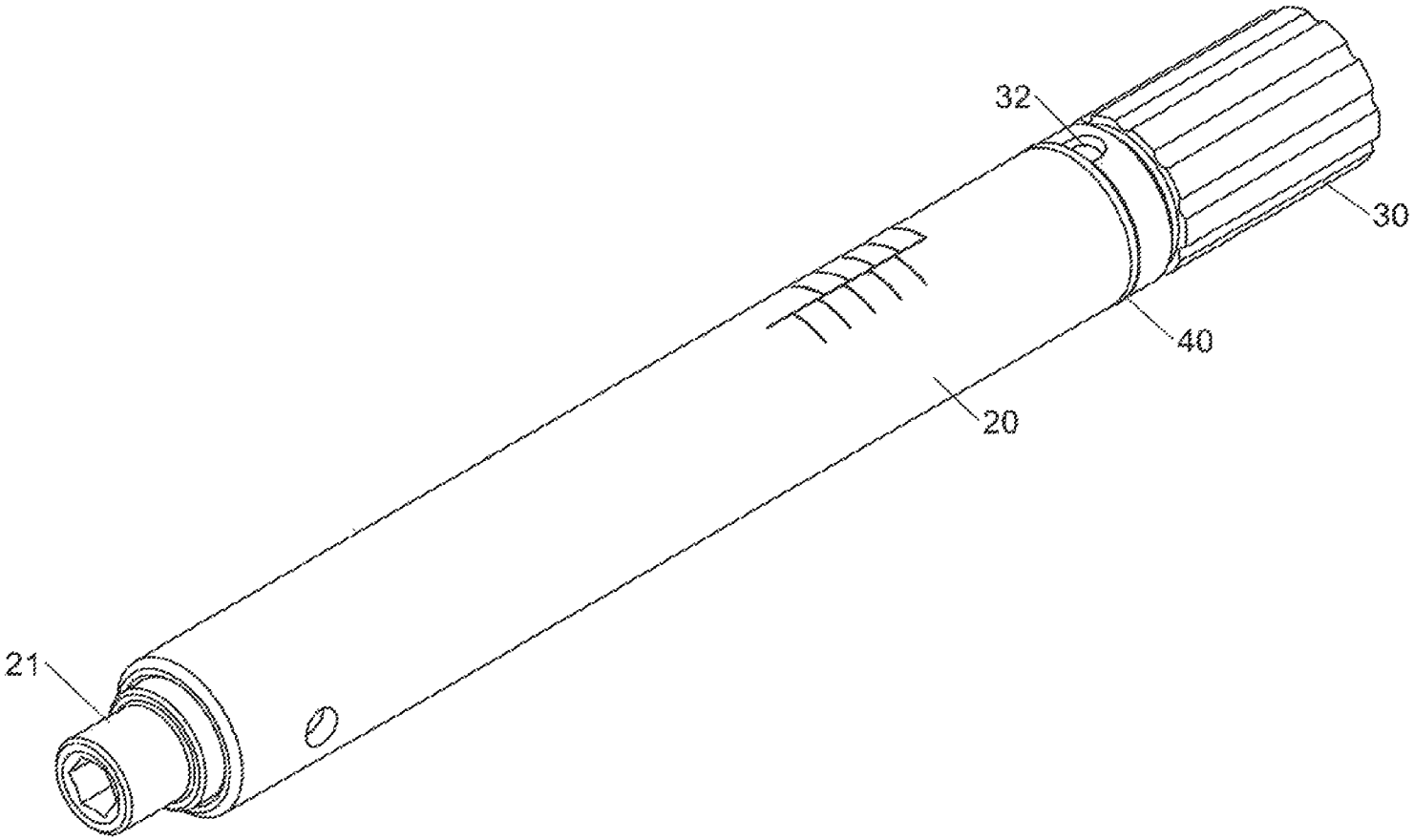
FIG. 8 is a partial perspective assembly view of a torque structure in accordance with the second preferred embodiment of the present invention.

Referring to FIG. 8 with reference to FIG. 4, each of the positioning grooves 313 has different length. Preferably, each of the positioning grooves 313 has a length of two times to allow the first body 10 moving relative to the second body 20.

Figure 9:
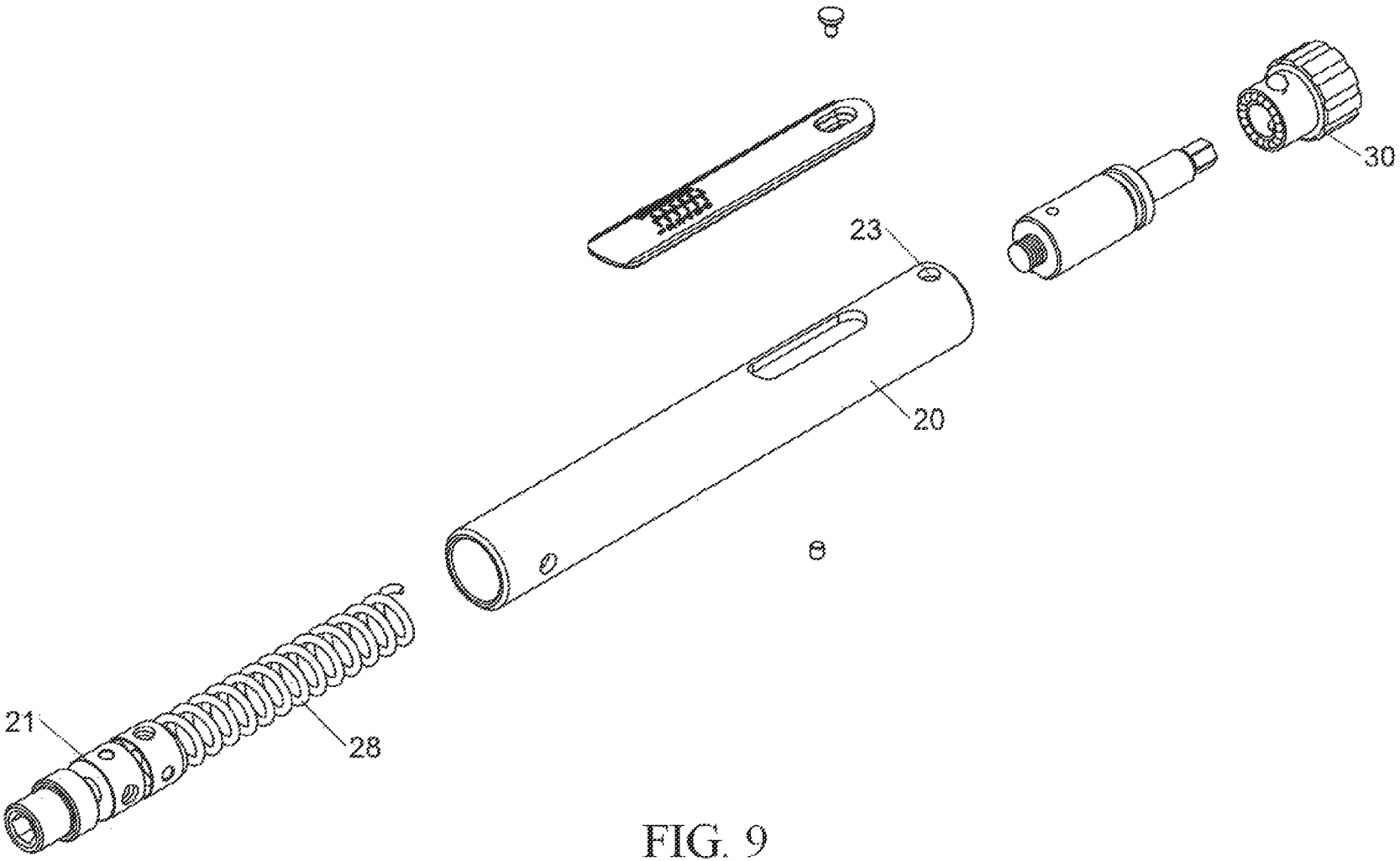
FIG. 9 is a partial exploded perspective view of a torque structure in accordance with the third preferred embodiment of the present invention.

Referring to FIG. 9 with reference to FIG. 2, the snap ring 40 and the annular groove 24 are undefined.

Figure 10:
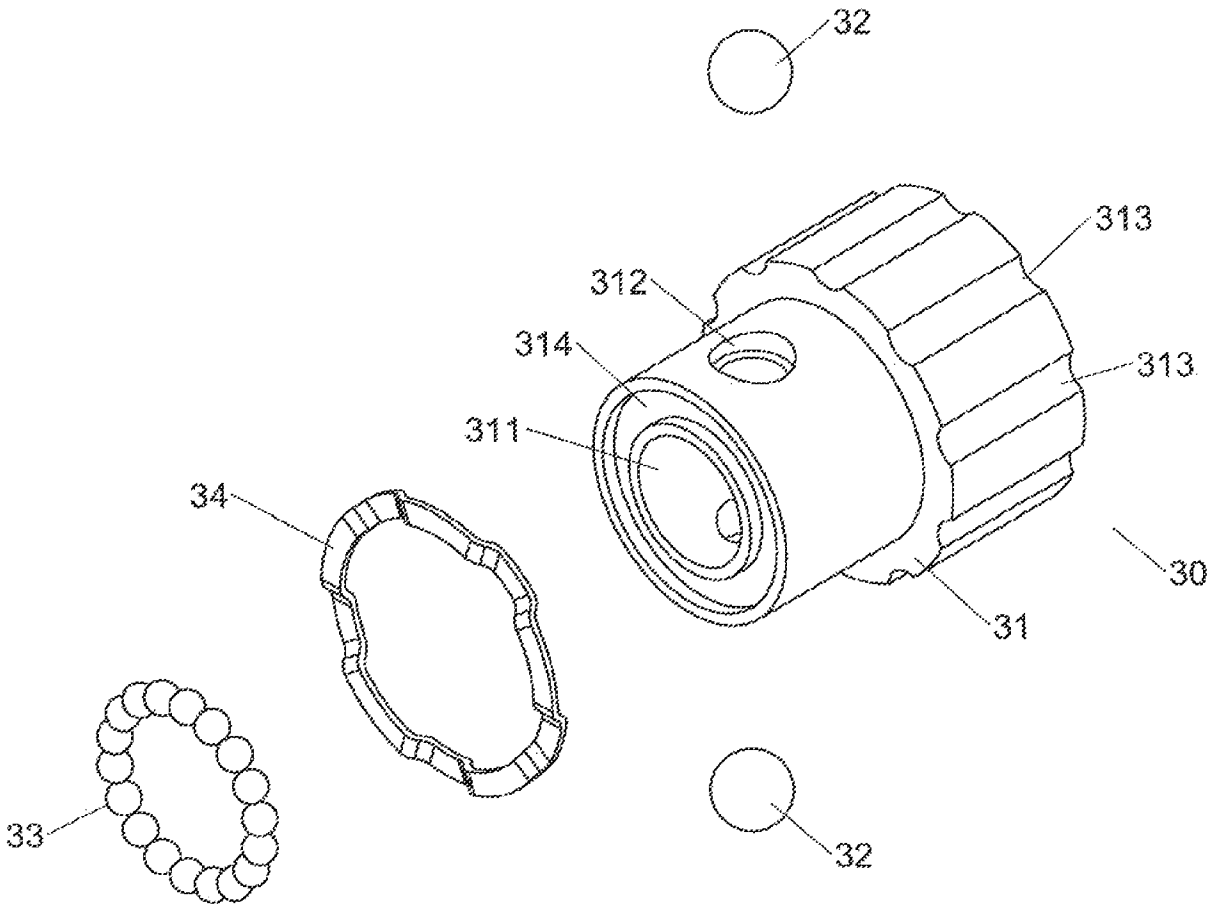
FIG. 10 is an exploded perspective view of the locking set of a torque structure in accordance with the fourth preferred embodiment of the present invention.

Referring to FIG. 10 with reference to FIG. 3, the washer 34 is a corrugated ring with elasticity.

Figure 11:
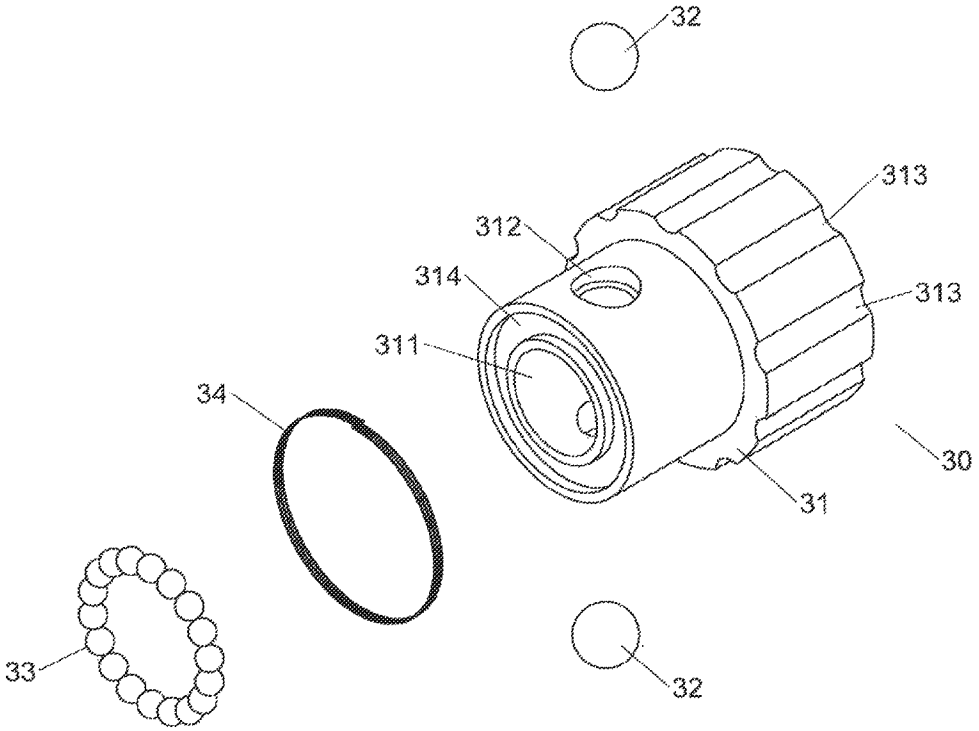
FIG. 11 is an exploded perspective view of the locking set of a torque structure in accordance with the fifth preferred embodiment of the present invention.

Referring to FIG. 11 with reference to FIG. 3, the washer 34 is an annular spring with elasticity.

Figure 12:
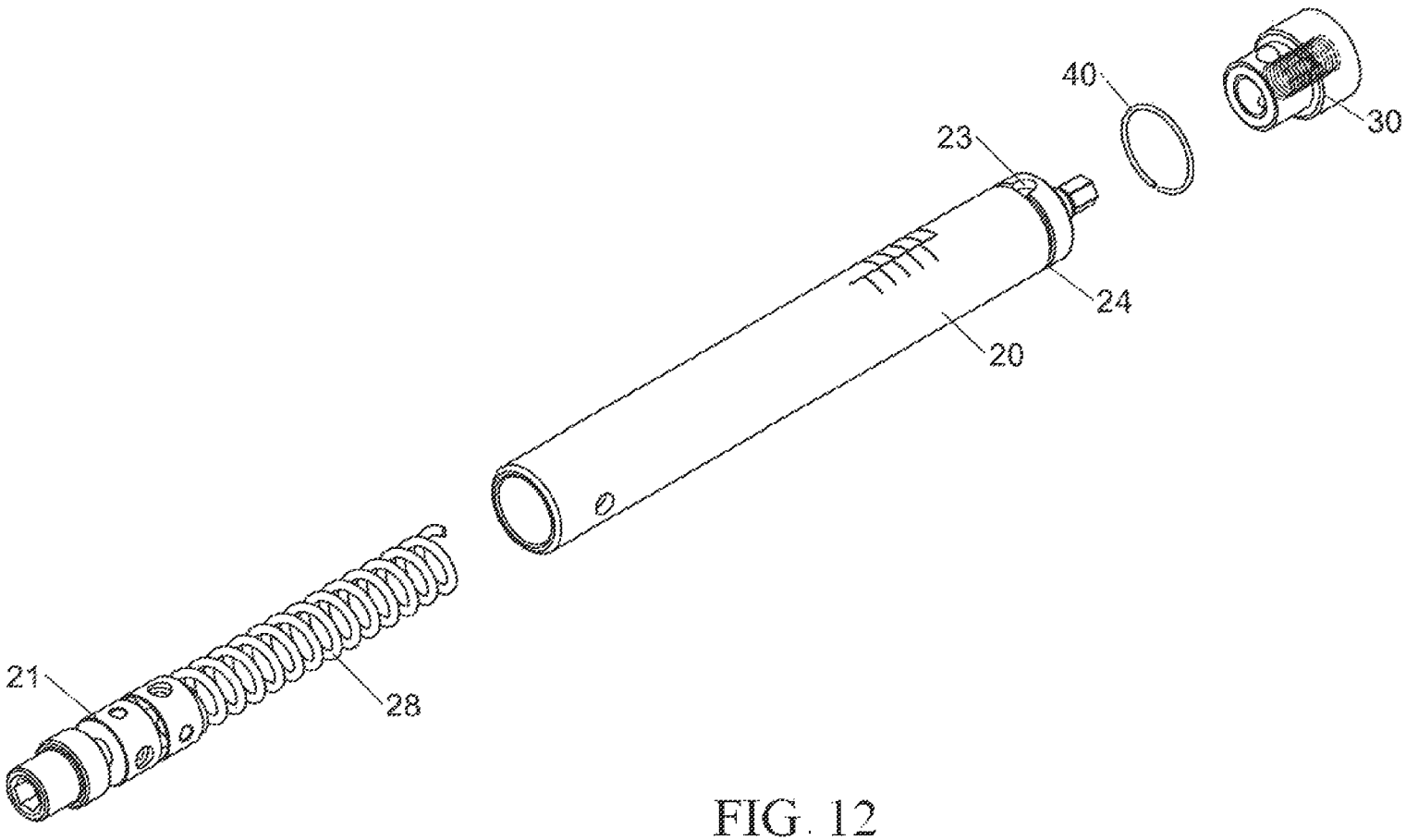
FIG. 12 is a partial exploded perspective view of a torque structure in accordance with the sixth preferred embodiment of the present invention.

Referring to FIG. 12 with reference to FIGS. 1-7, the second body 20 is provided with a plurality of scales. The positioning grooves 313 of the locking set 30 are undefined. The first body 10 is rotated and moved relative to the second body 20.

Accordingly, the torque structure has the following advantages.

1. The first securing portions 23, the second securing portions 312, and the securing members 32 are fit loosely so that the securing members 32 are assembled conveniently. Each of the securing members 32 rests on the first face 54 and the second face 55. The washer 34 is elastically biased between the second body 20 and the locking member 31 so that the second body 20 and the locking member 31 are spaced from each other by the elastic force of the washer 34. Thus, each of the securing members 32 is locked between the first face 54 and the second face 55 by the elastic force of the washer 34 to eliminate the gap between the locking member 31 and the second body 20 so that the locking member 31 and the second body 20 are fit closely. Thus, the torque structure has a double effect of easy assembly and gap elimination by provision of the washer 34.

2. The snap ring 40 is mounted in the annular groove 24 after assembly of the securing members 32 so that the securing members 32 are limited by the snap ring 40 and will not be detached from the first securing portions 23 and the second securing portions 312. Thus, the locking set 30 and the securing members 32 are mounted in the receiving chamber 11 easily.

3. The snap ring 40 is snapped onto the second body 20 and the securing members 32 so that the securing members 32 are limited by the snap ring 40 and will not be detached from the first securing portions 23 and the second securing portions 312. Thus, the snap ring 40 is used to retain the securing members 32.

4. The locking member 31 is a single element that is formed by injection molding to decrease the cost of fabrication.

5. The washer 34 pushes the second body 20 toward the drive portion 21 so that the first face 54 rests on each of the securing members 32, and each of the securing members 32 is locked between the first face 54 and the second face 55 by the elastic force of the washer 34. The snap ring 40 presses the securing members 32. Thus, each of the securing members 32 is retained by the snap ring 40, the first face 54, and the second face 55 and cannot not be detached from the first securing portions 23 and the second securing portions 312 so that the second body 20 and the locking set 30 are assembled exactly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A torque structure comprising:

a first body, a second body, an elastic member, and a locking set;

wherein:

the first body has an interior provided with a receiving chamber;

the second body is assembled with the first body;

the second body has a first end provided with a drive portion and a second end provided with a plurality of first securing portions and a first end face;

each of the first securing portions is hidden in the receiving chamber;

the first end face has a planar shape;

the elastic member is received in and elastically biased against the second body;

the locking set is assembled with the second body;

the locking set is received in the receiving chamber and includes a locking member, a plurality of securing members, a plurality of balls, and a washer;

the locking member is assembled with the second body and hidden in the receiving chamber;

the locking member has an interior provided with a pivot portion;

the locking member is provided with a plurality of second securing portions aligning with the first securing portions;

the locking member has a first end provided with a plurality of positioning grooves;

the positioning grooves protrude from the second body;

each of the positioning grooves has an arcuate shape;

the locking member has a second end provided with a ball groove;

the ball groove has an annular shape and is hidden in the second body;

the locking member is provided with a first peripheral face hidden in the second body and a second peripheral face protruding from the second body;

the second securing portions are provided on the first peripheral face;

the positioning grooves are provided on the second peripheral face;

the second peripheral face has a diameter more than that of the first peripheral face;

the second peripheral face has a first end provided with a second end face and a second end provided with a third end face;

the second end face faces the first end face and is spaced from the first end face;

the second end face is arranged between the second securing portions and the positioning grooves and has a planar shape;

the third end face has a planar shape;

the positioning grooves are connected to the second end face and the third end face;

each of the positioning grooves has a length equal to that of the second peripheral face and has a lengthwise direction the same as that of the second peripheral face;

the diameter of the second peripheral face is less than that of the receiving chamber and more than or equal to that of the second body;

the securing members are mounted in the first securing portions and the second securing portions so that the locking member is secured to the second body;

the first securing portions, the second securing portions, and the securing members are fit loosely;

the balls are rotatably mounted in the ball groove;

the washer is mounted on the locking member and made of resilient material;

the washer is elastically biased between the first end face and the second end face to space the second body from the locking member;

the washer eliminates a gap between the locking member and the second body;

each of the first securing portions has a first diameter, each of the second securing portions has a second diameter, and each of the securing members has a third diameter;

the first diameter is equal to the second diameter;

the third diameter is less than the first diameter and the second diameter;

the first securing portions, the second securing portions, and the securing members are fit loosely;

each of the first securing portions has a first face, and each of the second securing portions has a second face;

each of the securing members rests on the first face and the second face;

the washer is elastically biased between the second body and the locking member; and each of the securing members is locked between the first face and the second face.

2. The torque structure as claimed in claim 1, wherein:

the receiving chamber has a circular shape and penetrates the first body;

the second body has a tubular shape;

the second body is pivotally connected with the first body or secured with the first body; and the elastic member is a spring.

3. The torque structure as claimed in claim 1, wherein an indication unit is movably mounted on the second body to indicate a torque of the torque structure.

4. The torque structure as claimed in claim 1, wherein the drive portion partially protrudes from the first body, and the second body has two first securing portions which are arranged symmetrically.

5. The torque structure as claimed in claim 1, wherein:

the second body has a periphery provided with an annular groove connected to the first securing portions;

the torque structure further comprises a snap ring mounted in the annular groove and pressing the securing members so that each of the securing members is detached from each of the first securing portions;

the snap ring is arranged between the first body, the second body, and the securing members; and the snap ring is made of a metal ring with elasticity.

6. The torque structure as claimed in claim 1, wherein the washer is an O-ring.

7. The torque structure as claimed in claim 1, wherein the washer is a corrugated ring with elasticity.

8. The torque structure as claimed in claim 1, wherein the washer is an annular spring.

* * * * *